US005267814A

United States Patent [19]

Yoshida

[11] Patent Number: 5,267,814

[45] Date of Patent: Dec. 7, 1993

[54] MECHANISM AND METHOD FOR CONTINUOUSLY CONSTRUCTING REINFORCED CONCRETE TUNNEL

[76] Inventor: Tokuichiro Yoshida, 13-14 Ise-cho, Kawasaki-ku, Kawasaki 210, Japan

[21] Appl. No.: 878,625

[22] Filed: May 5, 1992

[30] Foreign Application Priority Data

Nov. 7, 1990 [JP] Japan ..... 2-301770

[51] Int. Cl.[5] ..... E21D 9/00

[52] U.S. Cl. ..... 405/146; 405/150.1

[58] Field of Search ..... 405/146, 147, 150.1, 405/141; 264/32-36

[56] References Cited

U.S. PATENT DOCUMENTS

| | | | |
|---|---|---|---|
| 3,487,649 | 1/1970 | Bergstrom | 405/146 |
| 3,561,223 | 2/1971 | Tabor | 405/147 X |
| 3,613,384 | 10/1971 | Jacobs | 405/146 X |
| 3,657,897 | 4/1972 | Krismer | 405/146 |
| 4,766,145 | 10/1988 | Dykmans | 264/34 X |

*Primary Examiner*—Dennis L. Taylor

*Attorney, Agent, or Firm*—Christie, Parker & Hale

[57] ABSTRACT

A mechanism for continuously constructing reinforced concrete tunnels is shown, which comprises a ring-like blade body having a rearwardly tapered inner surface like an earthenware mortar, a cylindrical wall extending integrally and rearwardly from the blade body and defining an inner space, a reinforcement member passage formed in the blade body and communicating the inner space in the cylindrical wall and an outer wall formation zone formed outside the cylindrical wall, and a concrete charging port formed in the blade body for charging concrete under a super-high pressure into the outer wall formation zone.

Through the inner space in the cylindrical wall and the reinforcement member passage is supplied a reinforcement member consisting of a main bar and branch bars in a state with the branch bars held bound together with the main bar, the branch bars becoming perpendicular to the main bar in the outer wall formation zone.

5 Claims, 2 Drawing Sheets

MECHANISM AND METHOD FOR CONTINUOUSLY CONSTRUCTING REINFORCED CONCRETE TUNNEL

BACKGROUND OF THE INVENTION

1. Field of the Invention

This invention relates to mechanism for continuously constructing reinforced concrete tunnels.

2. Prior Art

In the usual tunnel construction method, a great quantity of expensive agglomerating material is poured into the ground. In a prior art method of tunnel construction, the tunnel construction is advanced while assembling prefabricated concrete blocks in a bore formed to a somewhat excess size. In this case, the obtainable structure is mechanically weak because it is formed as its individual components or elements are connected to one after another.

Another drawback inherent in the prior art tunnel construction method is that a physical gap is formed between the tunnel body and the ground, thus giving rise to deformation of the ground and consequent accidents. A prelining process is a further prior art method of tunnel construction. Again in this case, a groove is formed around the tunnel face and then filled with concrete before digging further bore, and the process has similar inherent drawbacks. Further, if there is a spring in the work site of digging, it results in a difficult construction work, dictating a great deal of work expenditures and long time to effect digging for a unit distance.

SUMMARY OF THE INVENTION

An object of the invention is to provide a novel mechanism and a novel method for continuously constructing reinforced concrete tunnels, which can obviate the drawbacks discussed above inherent in the prior art.

Another object of the invention is to provide a mechanism and a method for continuously constructing reinforced concrete tunnels, which permit continuous construction of reinforced concrete tunnels having high mechanical strength.

A further object of the invention is to provide a mechanism and a method for continuously constructing reinforced concrete tunnels, which permit tunnel construction in mud-like grounds as well as hard grounds.

A still further object of the invention is to provide a mechanism and a method for continuously constructing reinforced concrete tunnels, which require only reinforcement members and water-proof raw concrete for tunnel construction.

To attain the above objects of the invention, there is provided a mechanism for continuously constructing reinforced concrete tunnels, which comprises a ring-like blade body having a rearwardly tapered inner surface like an earthenware mortar, a cylindrical wall extending integrally and rearwardly from the blade body and defining an inner space, a reinforcement member passage formed in the blade body and communicating the inner space in the cylindrical wall and an outer wall formation zone formed outside the cylindrical wall, and a concrete charging port formed in the blade body for charging concrete under a super-high pressure into the outer wall formation zone.

Through the inner space in the cylindrical wall and the reinforcement member passage is supplied a reinforcement member consisting of a main bar and branch bars in a state with the branch bars held bound together with the main bar, the branch bars becoming perpendicular to the main bar in the outer wall formation zone.

To permit quick solidification of concrete, a quick solidification agent supply port may be provided near the concrete charging port.

To permit construction of arcuate tunnels, the cylindrical wall may be formed from a plurality of wall sections having an equal length, with adjacent wall sections connected to each other by a nodal structure.

With the continuous reinforced concrete tunnel construction mechanism having the above construction according to the invention, it is possible to obtain a tunnel having an integral structure of water-proof reinforced concrete reinforced by longitudinal and transversal reinforcement bars and having high mechanical strength.

Further, the mechanism permits construction work in mud-like grounds as well as hard grounds.

Still further, the mechanism requires only reinforcement members and water-proof raw material for tunnel construction.

BRIEF DESCRIPTION OF THE DRAWINGS

The above and other objects, features and advantages of the invention will become more apparent when the same is read with reference to the accompanying drawings illustrating an embodiment of the invention, in which.

DETAILED DESCRIPTION OF THE PREFERRED EMBODIMENT

Figure 1:
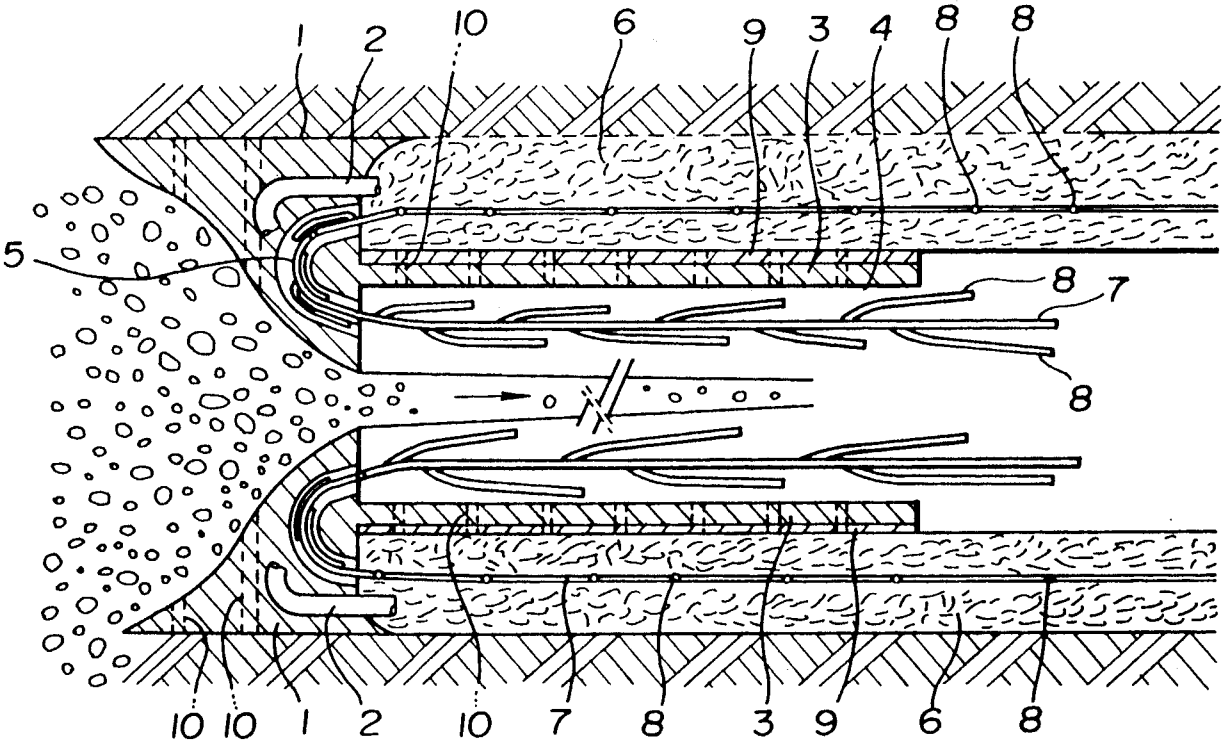
FIG. 1 is a sectional view illustrating the embodiment of the mechanism in use.
Figure 2:
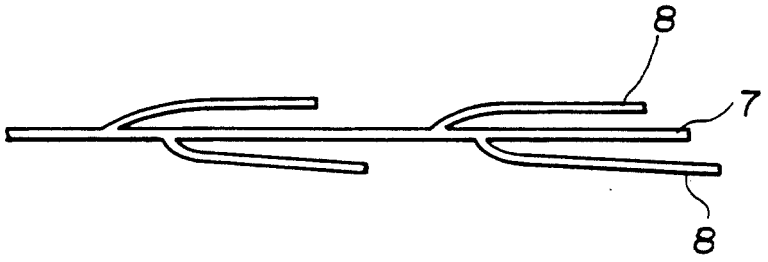
FIG. 2 is a side view showing a reinforcement member with branch bars thereof substantially parallel to a main bar.
Figure 3:
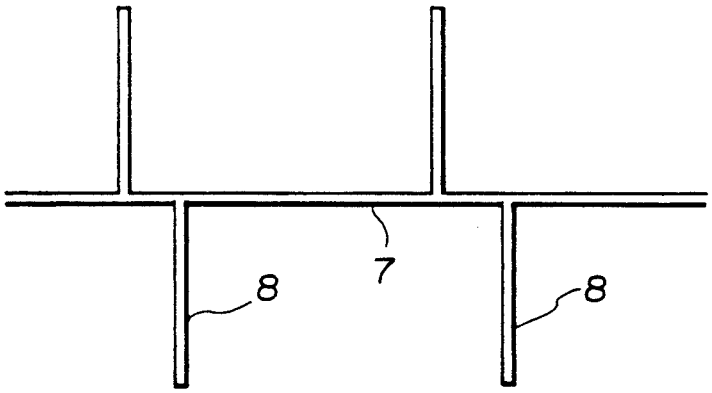
FIG. 3 is a side view showing the same reinforcement member with the branch bars perpendicular to the main bar.

As shown in FIG. 1, the mechanism comprises a ring-like blade body 1, which is inwardly tapering from its forward end like an earthenware mortar. The blade body 1 is advanced by the reaction force against super-high pressure, with which concrete is charged, and mechanical or other forces aiding the reaction force. The blade body 1 has a suitable number of rearwardly open concrete charging ports 2, and concrete is forced thereinto from the other end by means of hoses. The blade body 1 also has a rearwardly extending integral cylindrical wall 3 defining an inner space 4. The blade body 1 further has a suitable number of reinforcement member passages 5. Reinforcement members are supplied from the inner space 4 through the reinforcement passages 5 to an outer wall formation zone 6. FIGS. 2 and 3 show a reinforcement member. As shown, the reinforcement member consists of a main bar 7 and branch bars 8 extending therefrom. The branch bars 8 are adequately bound together by wires or the like so that they are in a state as shown in FIG. 2 as they pass through the inner space and the reinforcement member passages 5. Alternatively, they are forcibly passed through cylindrical passages. When they clear the reinforcement member passages 5, they are liberated with the binding wires cut by means of cutters and thus become perpendicular to the main bar 7, as shown in FIG. 3. Into the outer wall formation zone 6, concrete is pressure charged from the concrete charging ports. Mud or the like taken in by the blade body is conveyed rearwardly through the inner space by a conveyer or the like. The integral cylindrical wall 3 of the blade body serves as an inner wall for concrete charging. On the outer side, a separation agent and an elastic layer material are used to permit ready separation of concrete, and also quickly solidifying concrete is used, thus effecting continuous tunnel construction at a rate of several 10 cm to about several meters an hour.

The outer wall thus formed in the outer wall formation zone constitutes a tunnel.

To attain quick solidification of concrete, quick solidification agent supply ports are provided near the concrete charging ports.

The ends of the reinforcement members and end of cylindrical concrete body for the initial stage of the tunnel construction, are formed with provisional concrete frame and and reinforcement member setting in a well-known manner.

To permit construction of an arcuate tunnel portion, if necessary, in combination with a straight tunnel portion, the integral cylindrical wall 3 is formed from a plurality of wall sections having an equal length and, with adjacent wall sections connected to each other by a nodal structure 10.

The tunnel construction mechanism as a whole is advanced by the reaction force against a super-high pressure, with which concrete is charged. To aid this reaction force, a mechanical force is also used. Further, it is possible to use a well-known method to dig the bore forward. Mud that is taken :n is conveyed rearward through the inner space defined by the cylindrical wall 3. The reinforcement members are led with their branch bars bond together with their main bars from the inner space through the reinforcement member passages into the outer wall formation zone. As a result, the branch bars become perpendicular to the main bars, that is, the reinforcement members are spread. With the reinforcement members in this state, concrete is charged from the concrete charging ports into the outer wall formation zone. In this way, a strong integral reinforced concrete tunnel can be obtained, which is reinforced by the main and branch bars of the speed reinforcement members.

It is to be appreciated that according to the invention an integral structure of water-proof reinforced concrete reinforced by longitudinal and transversal reinforcement bars is produced in an overall tunnel construction process from the start until the end of digging the tunnel bore. Thus, the constructed tunnel has high mechanical strength. In addition, according to the invention, the construction work can be completed in mud-like grounds as well as hard grounds. Further, the necessary materials for the construction are only reinforcement members and water-proof raw concrete. Having the above various features, the invention is very useful.

Furthermore, the mechanism according to the invention can be utilized for the excavation of underground resources.

I claim:

1. A mechanism for continuously constructing reinforced concrete tunnels comprising a ring-like blade body having a rearwardly tapered inner surface like an earthenware mortar, a cylindrical wall extending integrally and rearwardly from said blade body and defining an inner space, a reinforcement member passage formed in said blade body and communicating said inner space and an outer wall formation zone formed outside said cylindrical wall, and a concrete charging port formed in said blade body for charging concrete under a super-high pressure into said outer wall formation zone, wherein a reinforcement member consisting of a main bar and branch bars is supplied with said branch bars held bound together with said main bar through said inner space and said reinforcement member passages, and said mechanism further comprises means for unbinding said branch bars upon exiting said reinforcement member passages so that said branch bars become perpendicular to said main bar in said outer wall formation zone.

2. The mechanism according to claim 1, which further comprises a quick solidification agent support port disposed near said concrete discharging port.

3. The mechanism according to claim 1, wherein said cylindrical wall includes a plurality of wall sections having an equal length, adjacent ones of said wall sections being connected to each other by a nodal structure.

4. A mechanism for continuously constructing reinforced concrete tunnels comprising a ring-like blade body having a rearwardly tapered inner surface like an earthenware mortar, a cylindrical wall extending integrally and rearwardly from said blade body and defining an inner space, a reinforcement member passage formed in said blade body and communicating said inner space and an outer wall formation zone formed outside said cylindrical wall, and a concrete charging port formed in said blade body for charging concrete under a super-high pressure into said outer wall formation zone, wherein said cylindrical wall includes a plurality of wall sections having an equal length, adjacent ones of said wall sections being connected to each other by a nodal structure to allow said cylindrical wall to flex in response to tunnelling along an arcuate path.

5. A method for continuously constructing reinforced concrete tunnels comprising a ring-like blade body having a rearwardly tapered inner surface like an earthenware mortar, a cylindrical wall extending integrally and rearwardly from said blade body and defining an inner space, a reinforcement member passage formed in said blade body and communicating said inner space and an outer wall formation zone formed outside said cylindrical wall, and a concrete charging port formed in said blade body for charging concrete under a super-high pressure into said outer wall formation zone, wherein said method comprises the steps of:

boring a tunnel with said blade body to form the outer wall formation zone outside side cylindrical wall;

charging concrete under a super-high pressure through said concrete charging port into said outer wall formation zone;

supplying a reinforcing member comprising a main bar and branch bars bound together to said main bar to fit through said inner space and said reinforcement member passages into said outer wall formation zone; and unbinding said branch bars from said main bar when said reinforcing member passes out of said reinforcement member passages and into said outer wall formation zone so that said branch bars become perpendicular to said main bar in said outer wall formation zone.

* * * * *